US005778279A

United States Patent [19]

Kawai et al.

[11] Patent Number: 5,778,279

[45] Date of Patent: Jul. 7, 1998

[54] IMAGE FORMING APPARATUS ESTIMATING A CONSUMABLE LIFE OF A COMPONENT USING FUZZY LOGIC

[75] Inventors: Atsushi Kawai, Aichi-ken; Tetsuya Sakai, Toyokawa, both of Japan

[73] Assignee: Minolta Co., Ltd., Osaka, Japan

[21] Appl. No.: 773,736

[22] Filed: Dec. 24, 1996

[30] Foreign Application Priority Data

Dec. 25, 1995 [JP] Japan ..... 7-337532

[51] Int. Cl.[6] ..... G03G 21/00

[52] U.S. Cl. ..... 399/42; 399/26; 399/27; 399/29; 399/42

[58] Field of Search ..... 399/24, 26, 27, 399/29, 30, 42; 395/900

[56] References Cited

U.S. PATENT DOCUMENTS

| | | | |
|---|---|---|---|
| 4,195,260 | 3/1980 | Sakamoto et al. | 399/29 |
| 4,536,080 | 8/1985 | Hauser et al. | 399/29 |
| 5,029,314 | 7/1991 | Katsumi et al. | 399/44 |
| 5,101,233 | 3/1992 | Ito et al. | 399/24 |
| 5,138,380 | 8/1992 | Umeda et al. | 399/26 |
| 5,214,476 | 5/1993 | Nomura et al. | 399/30 |
| 5,216,464 | 6/1993 | Kotani et al. | 399/24 |
| 5,225,873 | 7/1993 | Lux et al. | 399/26 |
| 5,307,118 | 4/1994 | Morita | 399/42 |
| 5,383,004 | 1/1995 | Miller et al. | 399/24 |
| 5,459,556 | 10/1995 | Acquaviva et al. | 399/42 X |

FOREIGN PATENT DOCUMENTS

| | | |
|---|---|---|
| 3-107873 | 5/1991 | Japan . |
| 3-166559 | 7/1991 | Japan . |
| 3-54576 | 8/1991 | Japan . |
| 4-97259 | 3/1992 | Japan . |
| 5-142908 | 6/1993 | Japan . |

*Primary Examiner*—Nestor R. Ramirez
*Attorney, Agent, or Firm*—McDermott, Will & Emery

[57] ABSTRACT

A copying machine equipped with a PC counter for counting cumulative rotation time of a photoconductive drum, a development counter for counting cumulative drive time of a developing unit, a sensor for detecting deposition amount of toner onto the photoconductive drum, a sensor for detecting toner concentration in the developer, and a humidity sensor. Based on output values from the counters and sensors, a control section of the copying machine estimates the degree of consumption of a consumable article by using fuzzy inference method or neural network, and thereby decides whether the consumable article have reached an end of life.

26 Claims, 12 Drawing Sheets

IMAGE FORMING APPARATUS ESTIMATING A CONSUMABLE LIFE OF A COMPONENT USING FUZZY LOGIC

BACKGROUND OF THE INVENTION

1. Field of the invention

The present invention relates to an image forming apparatus, and more particularly, to an image forming apparatus using an electrophotographic system, such as an electrophotographic copying machine and a laser printer.

2. Description of Related Art

Generally, for an image forming apparatus using an electrophotographic system, consumable articles need to be replaced at the end of their lifetime. For example, as the number of printed sheets increases, i.e., as the cumulative rotation time of the photoconductor increases, the photoconductor will be worn at its photoconductive layer, with the performance increasingly deteriorated. As the thickness of the photoconductive layer decreases, the chargeability deteriorates, causing a tendency that the image density lowers in the case of analog machines, while fogging to the image background increases in the case of digital machines. Meanwhile, in the case where a two-component developer comprising carrier and toner is used for development, the carrier will deteriorate as the number of printed sheets increases, i.e., as the cumulative drive time of the developing unit increases. Deterioration of the carrier causes deterioration of the chargeability to the toner, causing charging faults of the toner such that fogging of toner to the image background or scattering of toner to the machine interior becomes more likely to occur.

Thus, it has conventionally been practiced that servicemen replace the photoconductor or developer with new one when a certain number of printed sheets specified for each has been reached, so that occurrence of the above problems is prevented beforehand.

The degree of deterioration of the photoconductor due to wear can be expressed quantitatively to some extent in terms of photoconductive layer thickness value, which is a physical quantity to the photoconductor. It can be said that the smaller the value is, the further the photoconductor has deteriorated. Also, the degree of deterioration of carrier can be expressed quantitatively to some extent in terms of carrier spent value, which is a physical value to the carrier. It can be said that the larger the value is, the further the carrier has deteriorated. However, it is impossible for servicemen to measure the photoconductive layer thickness value or the carrier spent value at the user's place.

The wear amount of the photoconductive layer depends on the magnitude of stress to which the photoconductor surface is subjected with rotation, i.e., the cumulative rotation time of the photoconductor. Also, the carrier spent value depends on the magnitude of stress to which the carrier is subjected with stirring or the like in the developing unit, i.e., the cumulative drive time of the developing unit.

However, copying machines and printers in actual use, even with the same number of printed sheets, differ in the rotation time of the photoconductor or the drive time of the developing unit, from machine to machine, depending on differences in mode of use, for example, the frequencies of one-sheet printing mode and multi printing mode. Also, even with the same rotation time or drive time, the copying machines and printers differ in the wear amount of the photoconductive layer or the carrier spent value from machine to machine depending on the history of mode of use. Further, even if occurrence of toner fogging is detected, its cause could not be inferred because it is unclear whether the cause of the occurrence is deterioration of the photoconductor or that of the carrier, and because there are some other factors.

Consequently, indeed the number of printed sheets is a significant factor in deciding whether or not the photoconductor or the developer should be replaced, but it differs from machine to machine whether they have actually reached the end of life, depending on the state of use of individual machines. In some cases, even if a certain number of printed sheets has been reached, the photoconductor or the carrier has not deteriorated so much that neither the fogging nor the scattering of toner has occurred. In other cases, conversely, even before a certain number of printed sheets is reached, the photoconductor or the carrier has deteriorated so much that toner fogging or scattering occurs. Like this, many parameters in the image forming process are involved in detecting the deterioration of the photoconductor or the carrier, so that it has been impossible to define relational expressions as to the parameters definitely. Usually, the number of printed sheets to be referenced for replacement of the photoconductor or the developer is so set as to have a margin beforehand. As a result, it would be often the case that these members are replaced with new ones before they actually come to an end of life, uneconomically.

SUMMARY OF THE INVENTION

Accordingly, an object of the present invention is to provide an image forming apparatus which is capable of automatically deciding whether or not consumable articles, such as a photoconductor and a developer, have reached an end of life, by effectively estimating the degree of consumption of those consumables, in particular, the wear amount of the photoconductive layer for the photoconductor and the carrier spent value for the developer, so that the CPC (Cost Per Copy) can be reduced.

In order to achieve the above object, the image forming apparatus according to the present invention comprises detection means for detecting factors relating to degree of consumption of a consumable article, and decision means for estimating the degree of consumption of the consumable article based on detected values of the detection means and then deciding whether the consumable article has reached an end of life. The degree of consumption is estimated by detecting at least any one of the cumulative rotation time of the photoconductor, the cumulative drive time of the developing unit, the deposition amount of toner onto the photoconductor, the toner concentration in the developer and the humidity.

According to the invention, the end of life is determined by determining the degree of consumption comprehensively from various factors of consumption. Thus, it is possible to make a decision of life with higher reliability, so that the consumables can be replaced at a proper time according to the state of use of individual machines and that the CPC can be reduced. This is effective particularly to the decision as to deterioration of the photoconductor and the carrier.

Also, in the present invention, the end of life is determined by calculating an output by using a fuzzy inference method or a neural network for batch processing of input parameters. When the fuzzy inference method is used, the designer describes the knowledge relating to the wear amount of the photoconductive layer and the carrier spent value obtained during the system designing process, in terms of membership functions and language-related rules, thus enabling the inference. Therefore, the designer's know-how can be applied so that a decision of high accuracy can be achieved. Also, when the neural network is used, the inference processing can be defined rather simply from the facts which are based on experimental results even if there is no definite law which describes the relationship between input and output or if such a law is too complex. Moreover, in either processing of the fuzzy inference method or the neural network, there is no need of holding large-scale tables (data) of input and output within the control means, so that the memory can be saved.

BRIEF DESCRIPTION OF THE DRAWINGS

This and other objects and features of the present invention will become apparent from the following description with reference to the accompanying drawings, in which.

DETAILED DESCRIPTION OF THE PREFERRED EMBODIMENTS

Hereinbelow, embodiments of the present invention will be described with reference to the accompanying drawings. (First Embodiment, see FIGS. 1 to 16)

Figure 1:
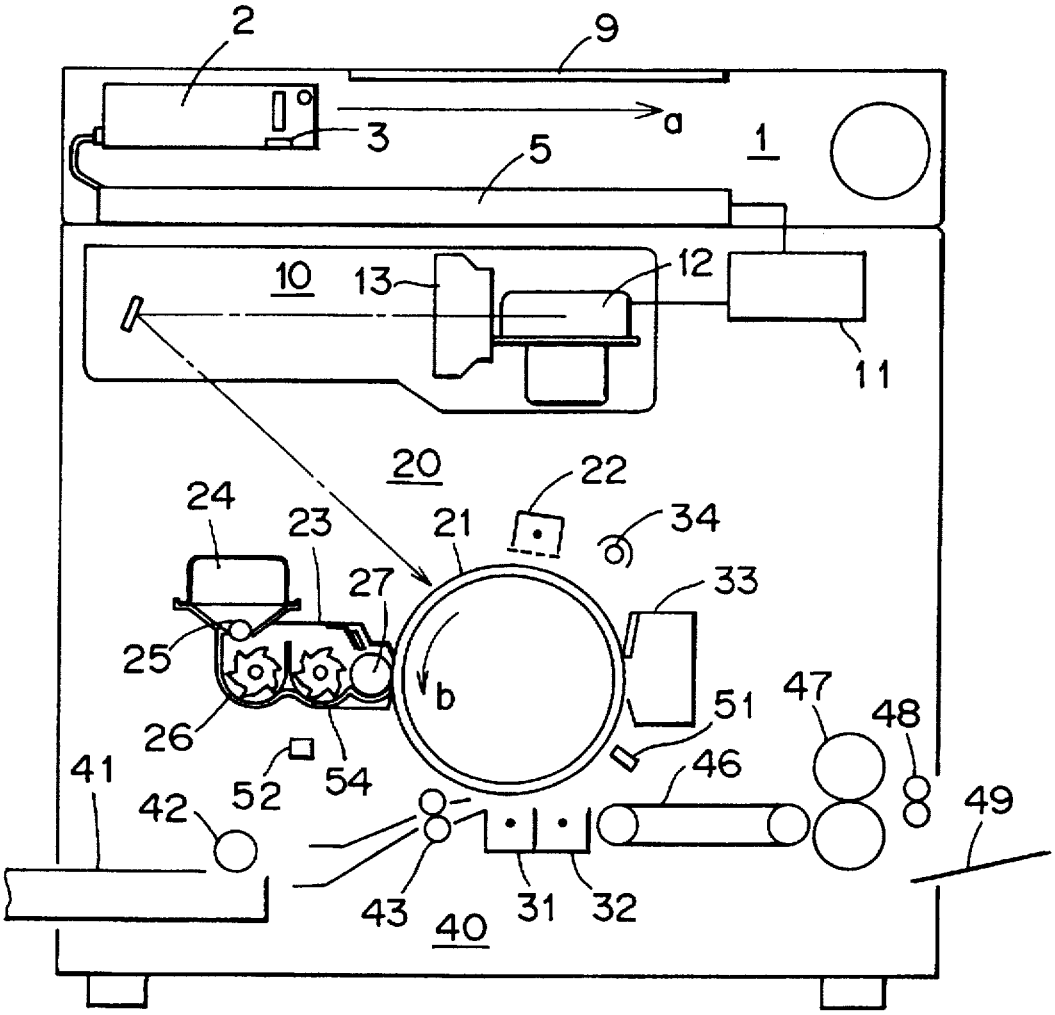
FIG. 1 is a sectional view of a digital copying machine which is an embodiment of the present invention showing the internal arrangement.

This first embodiment is to decide the end of life of the photoconductor, and FIG. 1 shows a digital copying machine which is the first embodiment of the invention. In this copying machine, an image reader unit 1 is placed at an upper stage, a laser scanning unit 10 is provided just under the image reader unit 1, and an image forming unit 20 and a sheet conveyance system 40 are disposed at an intermediate stage and a lower stage, respectively.

The image reader unit 1 comprises a scanner 2 which moves in the direction of arrow "a" to thereby read the image of a document set on a platen glass 9, and an image signal processor 5 which transforms the read image data into print data. The scanner 2 is a known type which comprises closecontact type line image sensors (CCDs) 3.

In the laser scanning unit 10, a light source driver 11 drives and modulates a light source (laser diode) based on the print data generated and edited by the image signal processor 5 so that a negative electrostatic latent image is formed on a photoconductive drum 21 with the potential attenuated in the image part. This laser scanning unit 10 comprises a polygon mirror 12, an θ lens 13 and the like, and its construction and function are well known.

The image forming unit 20 is made up primarily of the photoconductive drum 21 that rotates in the direction of arrow "b", and a corona charger 22, a developing unit 23, a transfer charger 31, a sheet separating charger 32, a cleaner 33 for residual toner, and an eraser lamp 34 for residual charges are arranged around the photoconductive drum 21. Further provided are an AIDC sensor 51 for optically detecting the amount of toner deposited onto the photoconductive drum 21 and a humidity sensor 52 for detecting the humidity within the machine. In addition, although the sensor 52 detects relative humidity, its detected values are converted into absolute humidity for use in this invention.

The developing unit 23 uses a two-component developer comprising a mixture of carrier and toner. The toner is stored in a hopper 24, and supplied to a stirring/circulation tank 26 by rotation of a supply roller 25. The supplied toner is stirred and circulated within the stirring/circulation tank 26, thereby electrically charged to a specified level by the friction against the carrier, and then supplied to the surface of the photoconductive drum 21 by a developing sleeve 27, thereby deposited onto image portions with the potential attenuated. In addition, in the stirring/circulation tank 26 is provided an ATDC sensor 54 for magnetically or optically detecting the concentration of toner contained in the developer.

The sheet conveyance system 40 feeds sheets stored in a paper cassette 41 one by one with a feed roller 42 rotating, and the sheet is sent to a transfer section as synchronized by a timing roller 43 with the toner image formed on the photoconductive drum 21. In the transfer section, the sheet has the toner image transferred thereon by discharge from the transfer charger 31, and has the charges erased by AC discharge from the sheet separating charger 32, and then separated from the photoconductive drum 21. The separated sheet is conveyed into a fixing unit 47 by an air suction belt 46, where the sheet undergoes the fixing of the toner image and then discharged through a discharge roller 48 onto a tray 49.

Figure 2:
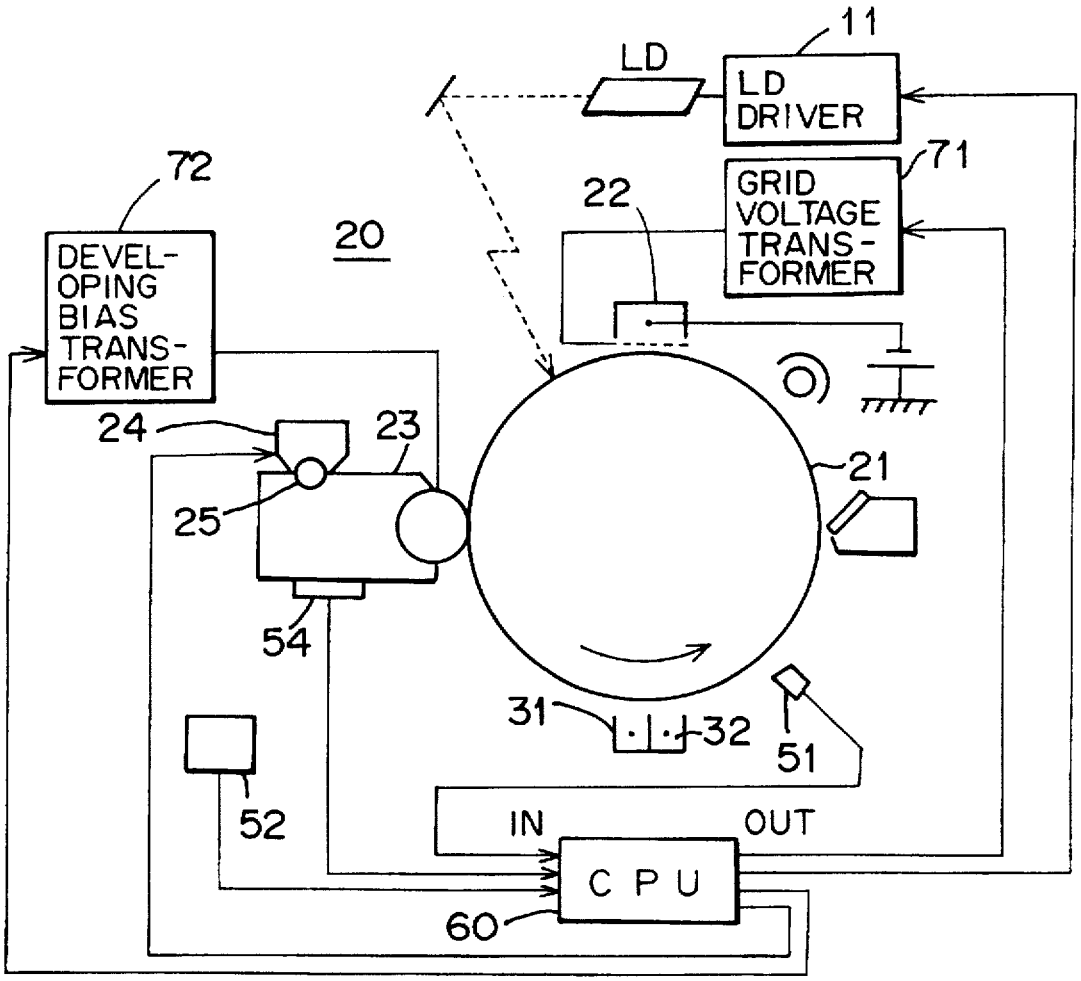
FIG. 2 is a block diagram showing the control circuit of the copying machine.

FIG. 2 shows the control mechanism of the copying machine.

The control mechanism is made up primarily of a CPU 60. The CPU 60 comprises a control ROM in which control programs are stored, a data ROM in which various data are stored, and a RAM in which various parameters are to be stored. In the data ROM, are stored various types of data necessary in executing the control of toner concentration, the control of image density, the control of decision as to deterioration of the photoconductor, and the like, which will be described later. Detected values derived from the AIDC sensor 51, the ATDC sensor 54, and the humidity sensor 52 are inputted to the CPU 60. The CPU 60 controls the light source driver 11, a grid voltage transformer 71, a developing bias transformer 72, the developing unit 23 and the toner hopper 24.

In the control mechanism, are installed a PC counter for integrating the rotation time of the photoconductive drum 21, and a development counter for integrating the drive time of the developing unit 23. Their respective integrated values are inputted to the CPU 60.

Figure 3:
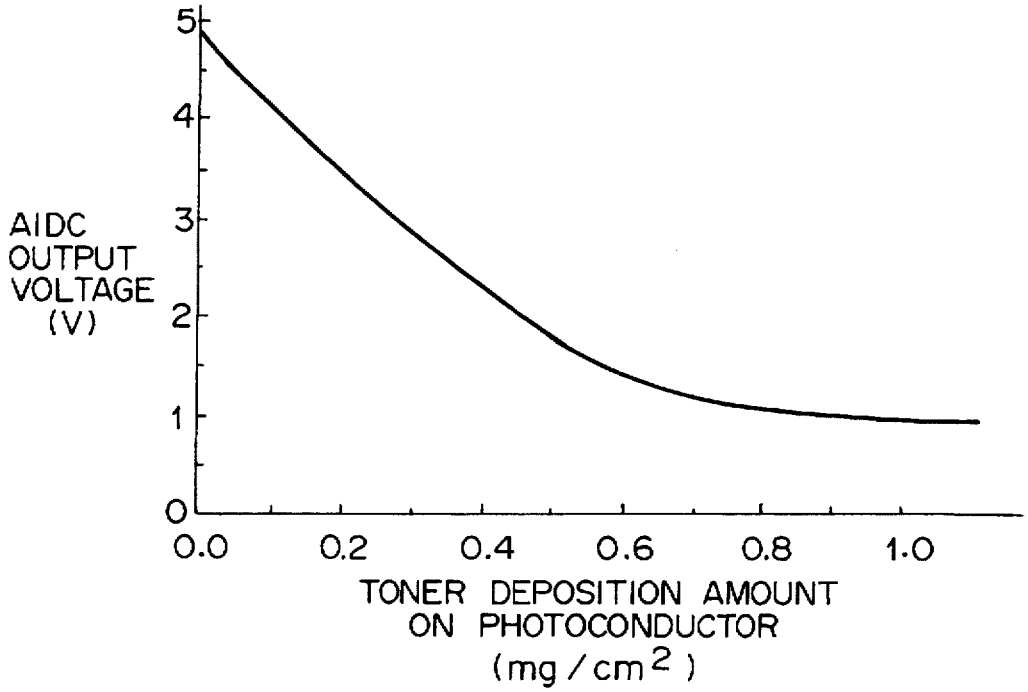
FIG. 3 is a graph showing the relationship between deposition amount of toner on the photoconductor and output voltage of the AIDC sensor.

In this copying machine, after an operation of forming one printed sheet has been completed, a reference pattern (reference toner image) of a certain area is formed outside the image forming area of the photoconductive drum 21, and the deposition amounts of toner to both the photoconductor ground and the reference pattern are detected optically by the AIDC sensor 51. An example of the relationship between the deposition amount of toner onto the photoconductor and the output voltage of the AIDC sensor 51 is shown in FIG. 3. The deposition amount of toner onto the ground allows the fogging state of toner to be determined therefrom, while the deposition amount of toner onto the reference pattern allows the image density to be determined therefrom.

Figure 4:
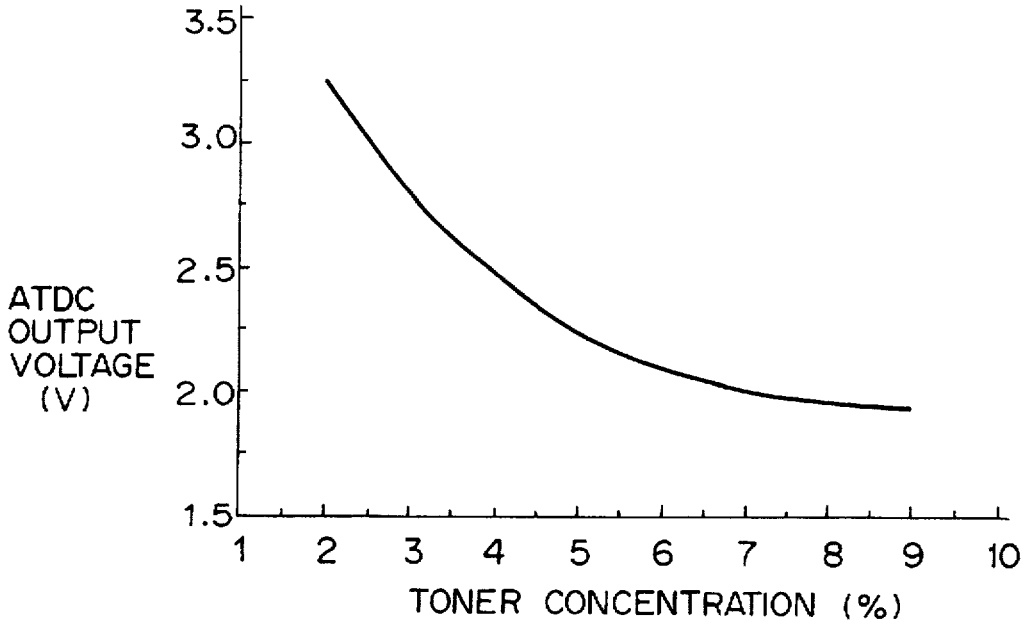
FIG. 4 is a graph showing the relationship between toner concentration and output voltage of the ATDC sensor.

Also, the output voltage of the ATDC sensor 54 allows variations in the concentration of toner in the developer to be monitored therefrom. For example, in the developer in a combination of certain kinds of carrier and toner, the relationship between the toner concentration in the developer and the output voltage of the ATDC sensor 54 is as shown in FIG. 4, where the toner concentration in the developer can be determined from the output voltage of the ATDC sensor 54.

The detected output value of the reference toner image by the AIDC sensor is compared by the CPU 60 with the output value for a preset reference deposition amount, and toner is resupplied from the toner hopper 24 so as to maintain the reference deposition amount. Such AIDC processing is well known.

Figure 5:
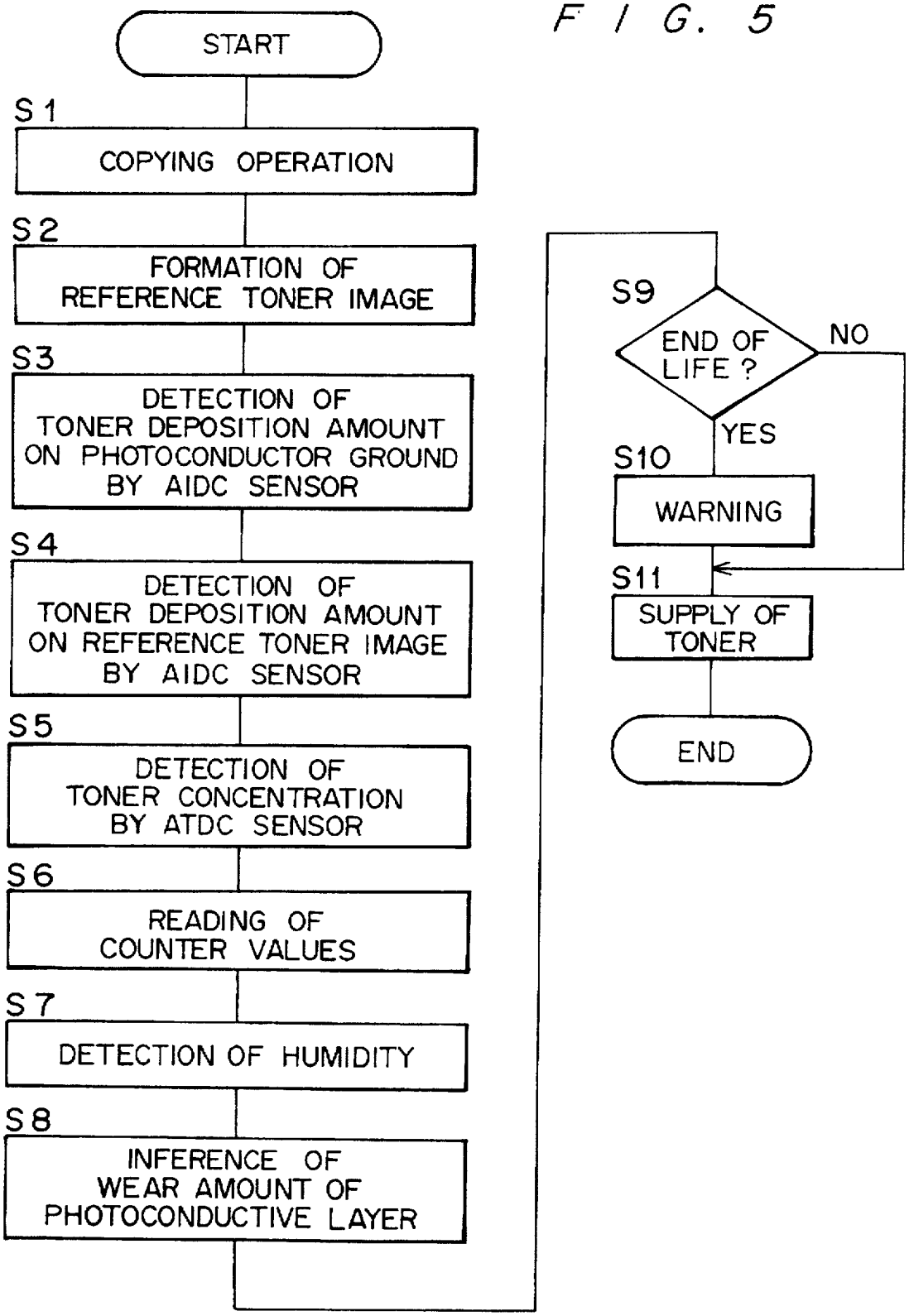
FIG. 5 is a flowchart showing the control procedure of the digital copying machine.

Next, the control procedure of the copying machine is explained with reference to the flowchart of FIG. 5.

First, a copying operation for making one copy is executed at step SI, and then a reference toner image is formed outside the image forming area on the photoconductive drum 21 under specified image forming conditions at step S2. Subsequently, the deposition amount of toner onto the photoconductor ground is detected by the AIDC sensor 51 at step S3, and the deposition amount of toner of the reference toner image is detected at step S4.

Further, at step S5, the toner concentration in the developer is detected by the ATDC sensor 54. At step S6, count values as to the cumulative rotation time of the photoconductive drum 21 and the cumulative drive time of the developing unit 23 are fetched from the PC counter and the development counter. At step S7, the humidity in the machine interior is detected by the humidity sensor 52.

Next, at step S8, the wear amount of the photoconductive layer is inferred based on information derived from the sensors and the counters. At step S9, it is decided whether or not the photoconductor has reached the end of life, where if it has, a warning is issued at step S10. The warning is implemented by displaying on the operation panel of the copying machine the fact that the photoconductor needs to be replaced, or by informing the remote service center of the fact via the telephone line connected to the copying machine. Finally at step S11, the toner is resupplied from the toner hopper 24 according to the detected output value of the reference toner image derived from the AIDC sensor 51.

Now an explanation is made on the relationship between data obtained from the image forming process and the life of the photoconductor.

The life of the photoconductor can be determined in terms of a physical property value called photoconductive layer thickness value. As the wear amount increases so that the thickness value decreases, the photoconductor deteriorates in chargeability, as described before. Generally, the wear of the photoconductive layer is due to the fact that the photoconductor is subjected to physical stress during rotation.

Figure 6:
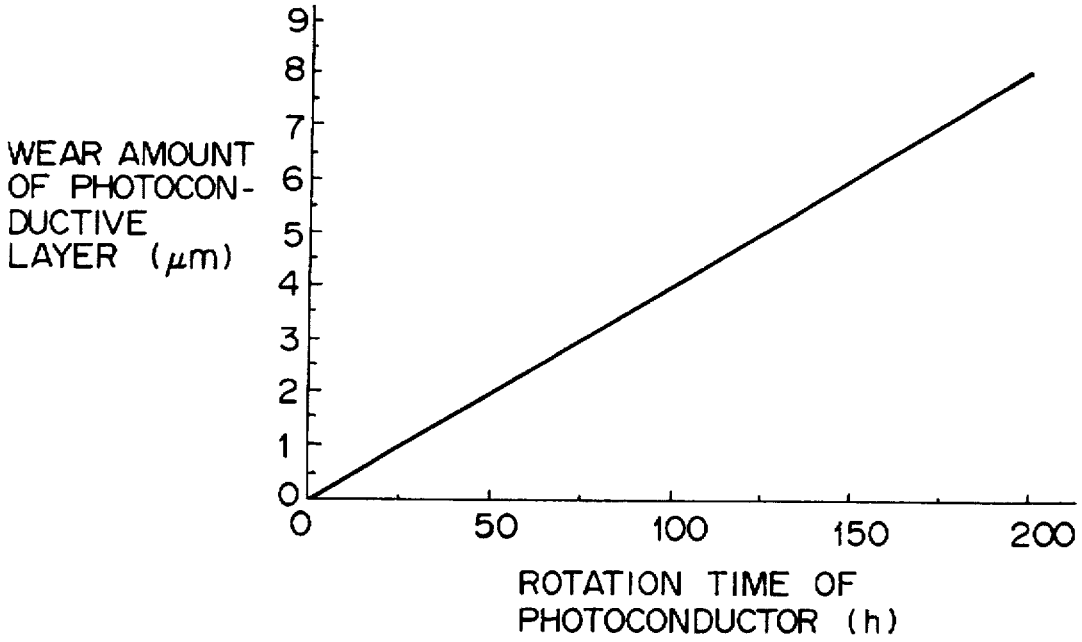
FIG. 6 is a graph showing the relationship between rotation time of the photoconductor and wear amount of the photoconductive layer.

FIG. 6 shows the wear amount of the photoconductive layer versus the rotation time of the photoconductor in this copying machine. This data was obtained by continuously rotating the photoconductive drum 21 under a normal environment of laboratories. In individual actual machines, however, because of differences in the history of use of printing modes and the like, the wear amount of the photoconductive layer could not be estimated by using the data of FIG. 6 as it is. Also, as the wear amount of the photoconductive layer increases, toner fogging becomes more likely to occur to the image background part for digital copying machines that involve reversal developing process. The toner fogging can be discriminated by detecting the deposition amount of toner onto the photoconductor ground by the AIDC sensor 51. However, the fogging will occur when the charged level of toner has lowered due to an increase in humidity, or when the toner concentration in the developer has increased excessively for some reason, or when the charged level of toner has lowered due to deterioration of the carrier. Therefore, the wear amount of the photoconductive layer cannot be estimated only by detecting the fogging of toner.

The wear amount of the photoconductive layer can be correctly estimated by detecting the deposition amount of toner onto the photoconductor ground, the humidity, the toner concentration, and the cumulative drive time of the developing unit 23 in addition to the cumulative rotation time of the photoconductive drum 21, and by comprehensively evaluating these detected values. For instance, when such conditions as a long rotation time of the photoconductor, a large deposition amount of toner onto the photoconductor ground, a high humidity, and a high toner concentration have been obtained from output values of the various sensors and counters, it can be considered that the factors of the large deposition amount of toner onto the photoconductor ground are the high humidity and the high toner concentration in addition to the long rotation time of the photoconductor. This case, it can be inferred, is less likely to be an occurrence of fogging due to the wear of the photoconductive layer.

As described above, there is a correlation between the data obtained from the image forming process and the wear amount of the photoconductive layer, so that the wear amount of the photoconductive layer can be correctly estimated by making a decision from various types of process data. Conventionally, because of a large number of parameters for the wear amount, it has been impossible to determine the input and output by giving a definition with definite relational expressions.

Thus, the present first embodiment employs a method using a neural network or a method using fuzzy inference for the estimation of the wear amount of the photoconductive layer at the foregoing step S8.

First explained is the method of inference by using a neural network.

In this inference method, output values from various sensors and counters with the state of image forming process varied are fetched, and the wear amounts of the photoconductive layer actually measured at that time are taken as teacher values, with which the learning of the neural network is executed. After the learning, output values of the sensors and counters are fed as input values of the neural network, from which a wear amount of the photoconductive layer is acquired and the life of the photoconductor is determined.

Figure 7:
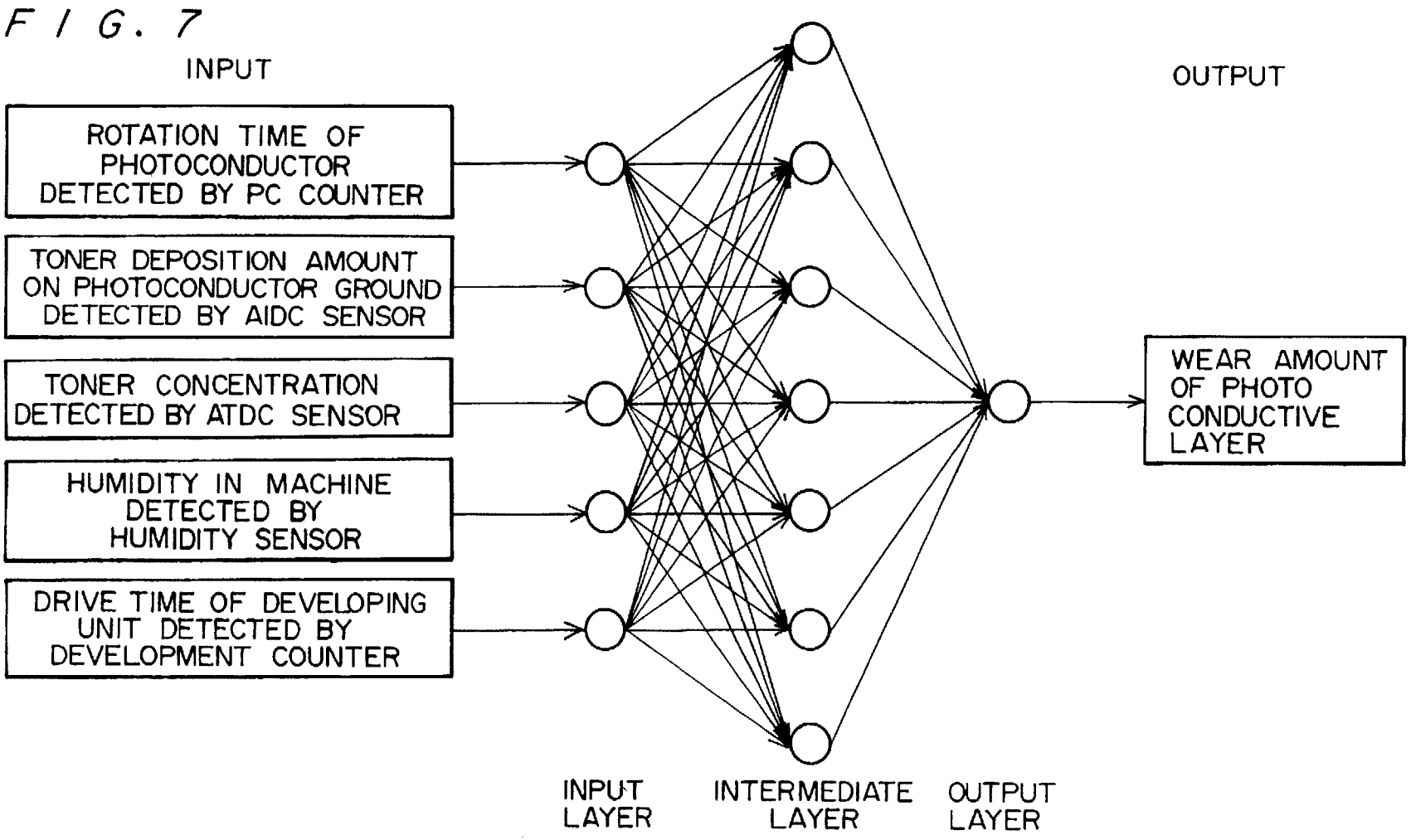
FIG. 7 is an explanatory view of a neural network.
Figure 8:
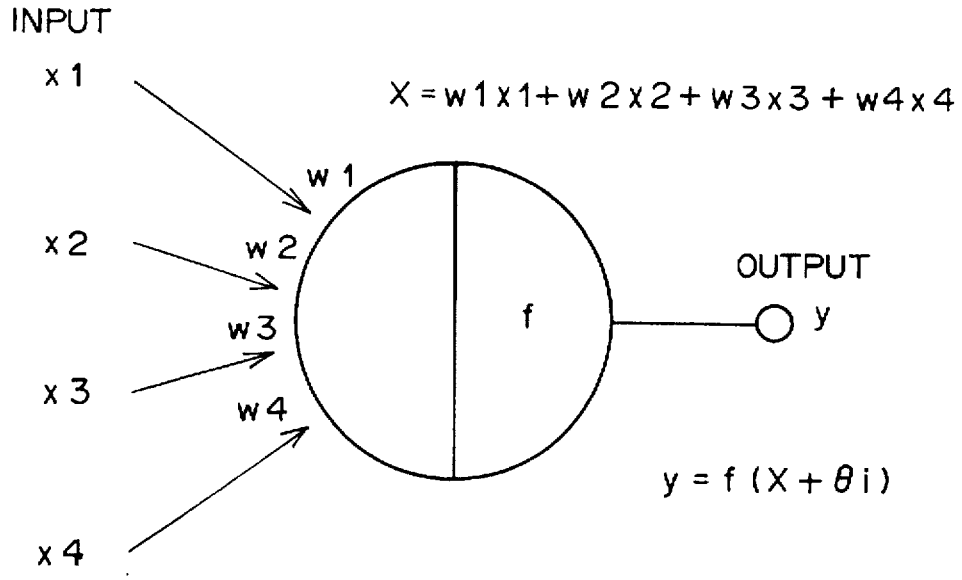
FIG. 8 is an explanatory view showing the input/output of each unit of the neural network.

FIG. 7 shows the structure of the neural network. The neural network is made up in a three-layer structure, including an input layer, an intermediate layer and an output layer. Each unit is coupled with the units of a layer adjacent to and other than the layer to which the unit belongs, via some coupling weight. A signal is transferred only in one way so as to be inputted to the coupled units. Used as each unit of the intermediate layer and the output layer is a multi-input one-output device, as shown in FIG. 8. In each of the units, an input value x1 is weighted with a coupling weight w1, and likewise, other input values x2, x3 . . . are weighted with coupling weights w2, w3 . . . , respectively. The weighted input values w1×1, w2×2, w3×3 . . . are summed up into a sum X, and the sum X is transformed by a response function f and is outputted as y. The output value (unit value) y can be expressed by $$y = f(X + \theta(i))$$

$$X = \sum_i w1x1$$

where θ(i) is the threshold of each unit.

Figure 9:
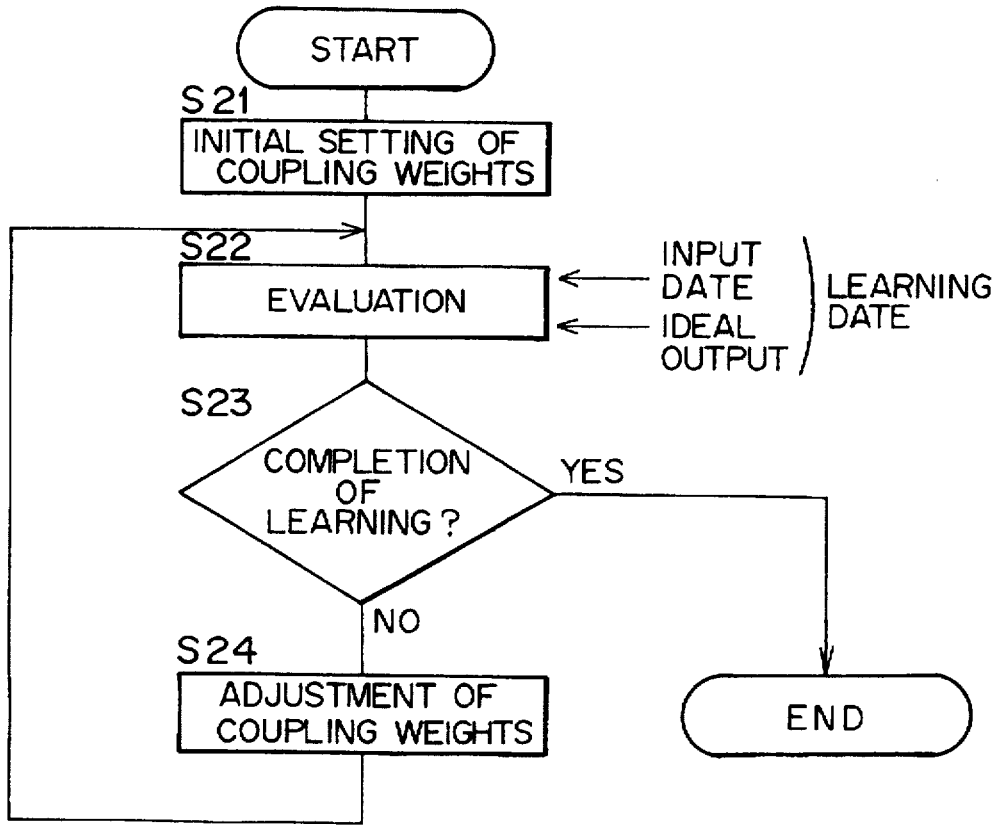
FIG. 9 is a flowchart showing the learning procedure of the neural network.

The learning model of the neural network is generally implemented by such a procedure as shown in FIG. 9.

First, a coupling weight w for each coupling is initially set in random value (step S21). Next, by giving an ideal output for an input signal from external as a teacher signal to this coupling weight, the coupling weight is evaluated by referring to evaluation criteria (step S22). Then, the value of the coupling weight is adjusted based on the evaluation result (step S24), and evaluated again. By iterating such a process, the coupling weight is made to approach an optimum value gradually.

Figure 10:
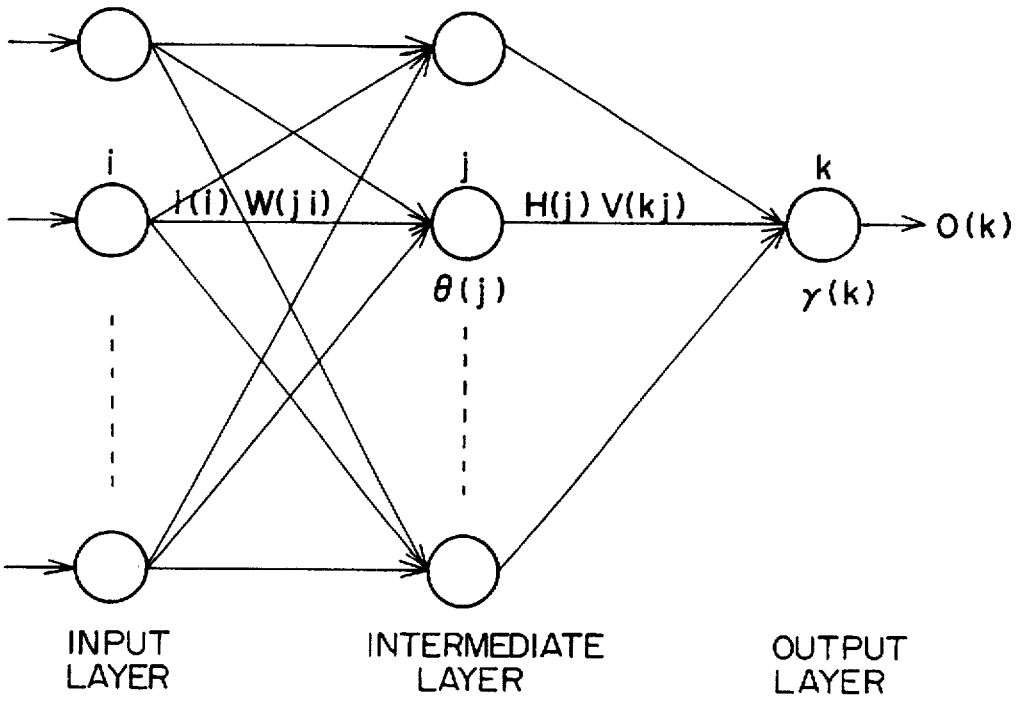
FIG. 10 is an explanatory view showing the learning of the neural network.

The learning of the neural network is carried out by the three-layer back propagation method. As shown in FIG. 10, here is discussed a model in which: an output I(i) of the "i"th unit of the input layer to the "j"th unit of the intermediate layer is weighted with a coupling weight W(ji); other outputs from the input layer to the "j"th unit of the intermediate layer are weighted with respective coupling weights; these weighted values and a threshold θ(j) are added up; the sum is transformed by a function f to determine an output H(j) of the "j"th unit of the intermediate layer; the output H(j) sent to the output layer is weighted with a coupling weight V(kj); other outputs from the intermediate layer to the output layer are weighted with respective coupling weights; these weighted values and a threshold γ(k) are added up; and the sum is transformed by a function f to determine an output O(k) of the output layer.

Input data fed to the input layer is propagated to the intermediate layer and the output layer while being subjected to weighting calculation (product-sum operation of coupling weights and unit values). The unit value (output) of the output layer is compared with teacher data corresponding to the input data, and the degrees of coupling between output layer and intermediate layer and between intermediate layer and input layer are corrected so that the error between the unit value and the teacher data is lessened. By iterating this correction, the output of the output layer approaches the teacher data. The sequence of these operations is iterated sufficiently with respect to all the input data, by which the values shown by the teacher data can be outputted with respect to various input data.

The unit values of the individual layers are as follows:

Unit value of intermediate layer:

$$H(j) = f\left\{ \sum_i W(ji)I(i) + \theta(j) \right\}$$

Unit value of output layer:

$$O(k) = f\left\{ \sum_j V(kj)H(j) + \gamma(k) \right\}$$

where H(j):output of the "j"th unit of the intermediate layer;

O(k):output of the output layer;

I(i):output of the "i"th unit of the input layer;

θ(j):threshold of the "j"th unit of the intermediate layer;

γ(k):threshold of the output layer;

W(ji):weight of the "j"th unit of the intermediate layer for the "i"th unit of the input layer; and V(kj):weight of the output layer for the "j"th unit of the intermediate layer.

The function f(X) is a nonlinear continuous function called sigmoid function, by which function the input-output characteristic of the unit is determined so that the output value is restricted to the range of O≧H(j), O(k), I(i)≧1.

$$f(X) = 1/\{1 + \exp(-2x/u0)\}$$
$$= \{1 + \tanh(x/u0)\}/2$$

where u0:parameter that determines the gradient of the sigmoid function.

The initially set values for the coupling weights W(ji), V(kj) and the thresholds θ(j), γ(k) are small random values.

The function of a square of the difference, or square error, between the output and the teacher signal is referred to as an error function. The error function E(p) with respect to a pattern "p" and the error Et with respect to all patterns can be expressed as follows:

$$E(p) = \Sigma\{T(kp) - O(kp)\}^2/2$$

$$Et = \sum_p E(p)$$

Based on that the state in which the error Et comes to a minimum is assumed as an optimum neural network, the coupling weights and the thresholds are corrected so that Et becomes a minimum. This correction is carried out as follows:

From the difference between the teacher signal T(k) of the learning pattern and the output O(k) of the output layer, the error δ(k) with respect to the coupling weight V(kj), which is coupled with the output layer, and the threshold γ(k) of the output layer is determined by the following equation:

$$\delta(k)=2\times\{T(k)-O(k)\}\times O(k)\times\{1-O(k)\}/u0$$

From the error δ(k), the coupling weight V(kj) from the intermediate layer to the output layer and the output H(j) of the intermediate layer, the error δ(j) with respect to the coupling weight W(ji) coupled with the "j"th unit of the intermediate layer and the threshold θ(j) of the "j"th unit of the intermediate layer is determined by the following equation:

$$\delta(j)=2\times\left\{\sum_k \delta(k)\right\}\times V(kj)\times H(j)\times\{1-H(j)\}/u0$$

The coupling coefficient V(kj) connecting from the "j"th unit of the intermediate layer to the output layer is corrected by adding the product of the error δ(k) at the output layer, the output H(j) of the "j"th unit of the intermediate layer and a constant α. Also, the threshold γ(k) of the output layer is corrected by adding the product of the error δ(k) and a constant β.

$$V(kj)+\alpha\times\delta(k)\times H(j)$$

$$\gamma(k)=\gamma(k)+\beta\times\delta(k)$$

The coupling coefficient W(ji) connecting from the "i"th unit of the input layer to the "j"th unit of the intermediate layer is corrected by adding the product of the error δ(j) at the "j"th unit of the intermediate layer, the output I(i) of the "i"th unit of the input layer and the constant α. Also, the threshold θ(j) of the "j"th unit of the intermediate layer is corrected by adding the product of the error δ(j) and the constant β.

$$W(ji)=W(ji)+\alpha\times\delta(j)\times I(i)$$

$$\theta(j)=\theta(j)+\beta\times\delta(j)$$

The error E(p) is minimized by executing this calculational expression with respect to one input/output pattern (p), and the error function Et as a whole is minimized by executing the learning with respect to all the input patterns.

In this embodiment, the learning is carried out by the aforementioned back propagation method by using a hierarchical neural network having an input layer with five units, an intermediate layer with seven units, and an output layer with one unit.

For the learning calculation or output calculation of a neural network, the input/output data needs to be standardized to between 0 and 1. Therefore, experimental data obtained are standardized to a value between 0 and 1 within a range of minimum to maximum values.

In this embodiment, the teacher data obtained by experiments are standardized within the ranges shown in Table 1 below in order to yield an output value of the neural network:

TABLE 1

| | | Min.–Max. |
|---|---|---|
| Input data | Rotation time of photoconductor | 0–100000 (m) |
| | Deposition amount of toner on ground | 0–0.1 (mg/cm$^2$) |
| | Toner concentration | 0–10 (%) |
| | Humidity in machine | 0–100 (%) |
| | Drive time of developing unit | 0–12000 (m) |

TABLE 1-continued

| | | Min.–Max. |
|---|---|---|
| Output data | Wear amount of photoconductive layer | 0–10 (μm) |

For example, given teacher data is standardized as shown in Table 2 below:

TABLE 2

| | | Before standardization → After standardization |
|---|---|---|
| Input data | Rotation of photoconductor | 60000 → 0.6 |
| | Deposition amount of toner on ground | 0.02 → 0.2 |
| | Toner concentration | 6 → 0.6 |
| | Humidity in machine | 20 → 0.2 |
| | Drive time of developing unit | 3000 → 0.25 |
| Output data | Wear amount of photoconductive layer | 4 → 0.4 |

Teacher data obtained by experiments are standardized in this way, and the learning is executed by using the standardized teacher data. In this embodiment, the number of pieces of teacher data is 120 in all, and the learning is iterated until the square error is minimized to a sufficiency by a computer, by which the coupling weight and the thresholds are determined.

After the completion of the learning, the processing program for the part of calculating the output of the neural network having the determined coupling weights and thresholds is incorporated into the control program ROM as a routine for estimating the wear amount of the photoconductive layer.

In copying process, data obtained from outputs of the various sensors and counters are standardized so as to match the type of input and output of the neural network, and then fetched as input values for the processing program of the neural network, followed by the calculation of an output value. The output value is converted from the standardized value into an actual value, by which a wear amount of the photoconductive layer is obtained.

Otherwise, without incorporating the processing program of the neural network into the control ROM, the wear amount of the photoconductive layer may be obtained by calculating an output value for the combination of inputs by a previously learned neural network, incorporating the calculated values into data ROM as a data table, and by selecting output data for input data from the data table.

Next, the fuzzy inference method is explained.

In this case, the life of the photoconductor is determined by defining the status amounts of various processes with membership functions, preparing control rules from the relationship obtained from experiments or the like and executing fuzzy inference for outputting a wear amount of the photoconductive layer with the status amounts of the processes taken as inputs. In this embodiment, the inputs are rotation time of the photoconductor, deposition amount of toner on the photoconductor ground, toner concentration, humidity, and drive time of the developing unit, while the output is wear amount of the photoconductive layer.

Figure 11:
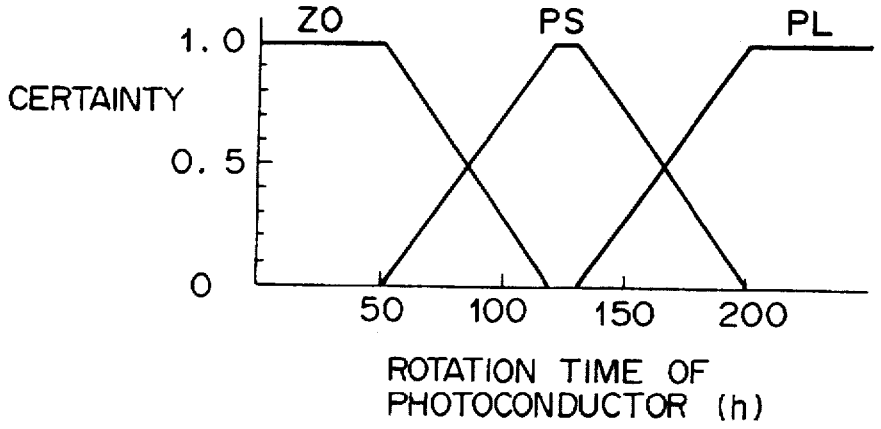
FIG. 11 is a chart showing a membership function (rotation time of photoconductor) in the fuzzy inference method.
Figure 12:
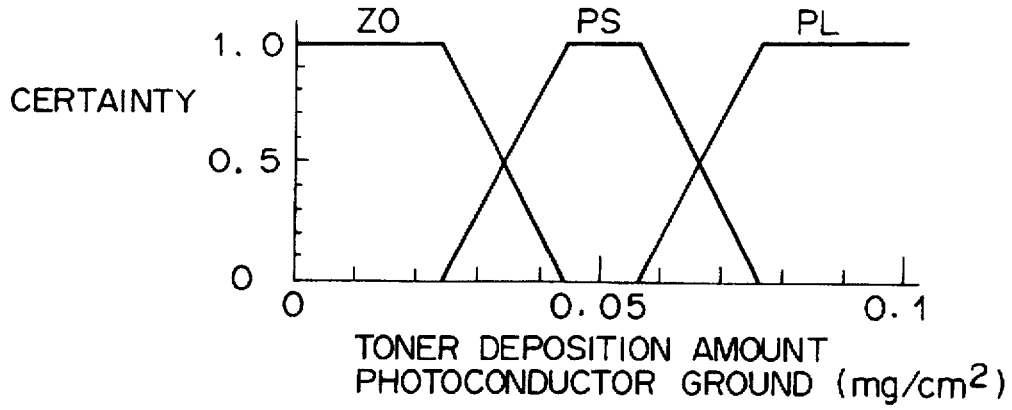
FIG. 12 is a chart showing a membership function (deposition amount of toner on ground) in the fuzzy inference method.
Figure 13:
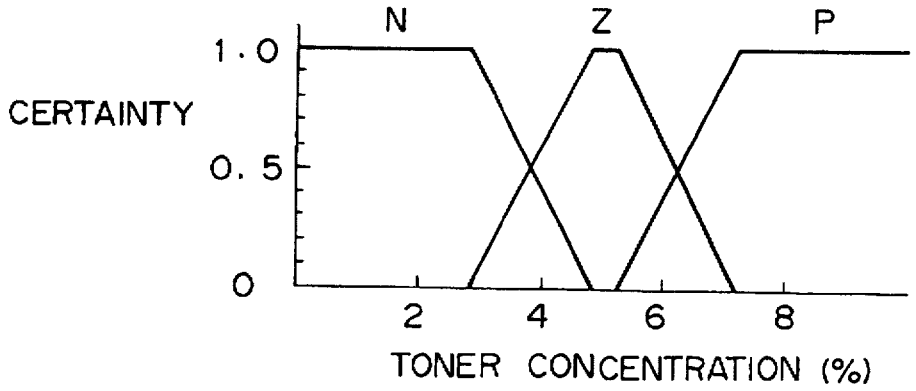
FIG. 13 is a chart showing a membership function (toner concentration) in the fuzzy inference method.
Figure 14:
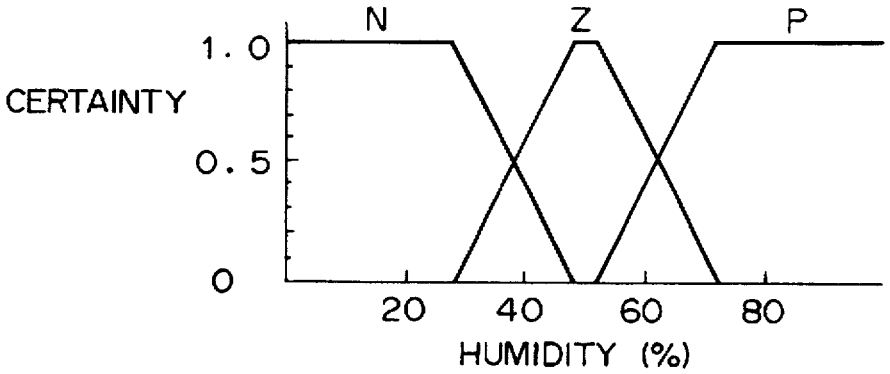
FIG. 14 is a chart showing a membership function (humidity) in the fuzzy inference method.
Figure 15:
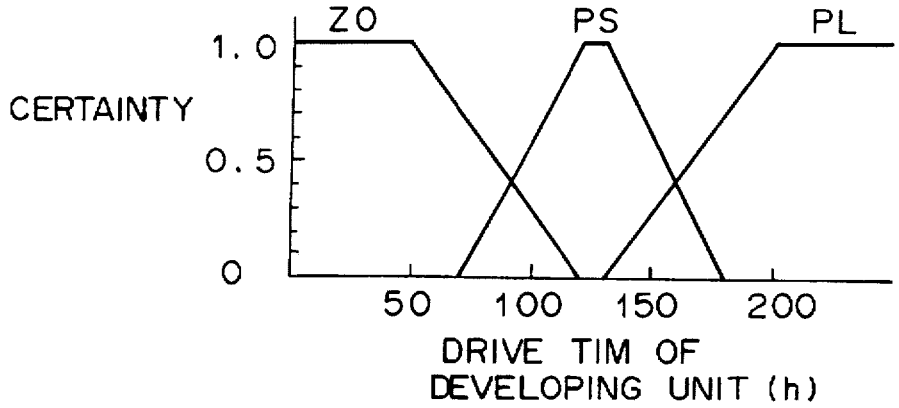
FIG. 15 is a chart showing a membership function (drive time of developing unit) in the fuzzy inference method.
Figure 16:
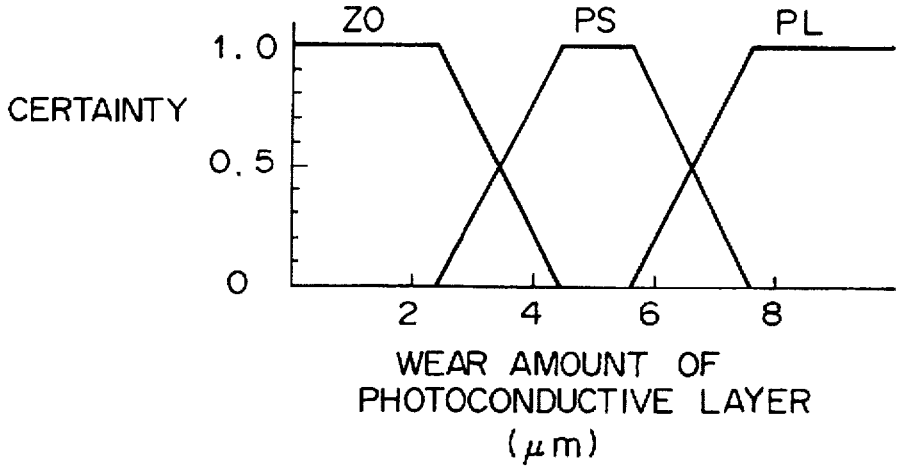
FIG. 16 is a chart showing a membership function (wear amount of photoconductive layer) in the fuzzy inference method.

As the membership functions, the fuzzy sets of process status amounts and control amounts are defined as shown in FIGS. 11 to 16:

Reference characters shown in FIGS. 11 to 16 represent as follows:

For the rotation time of photoconductor in FIG. 11,
ZO: standard
PS: a little long
PL: very long For the deposition amount of toner at ground in FIG. 12,
ZO: standard
PS: a little high
PL: very high For the toner concentration in FIG. 13,
N: low
Z: standard
P: high For the humidity in FIG. 14,
N: low
Z: standard
P: high For the drive time of developing unit in FIG. 15,
ZO: standard
PS: a little long
PL: very long For the wear amount of photoconductive layer in FIG. 16,
ZO: standard
PS: a little large
PL: very large In FIGS. 11 to 16, the vertical axis of the graph represents the certainty of the fuzzy sets for their respective reference characters, and assumes any value within the range of 0 to 1. For example, as shown in FIG. 11, when the rotation time of the photoconductor is 100 hours, ZO and PS are selected as status amounts, where the certainty of ZO is 0.28 and the certainty of PL is 0.70. Like this, the certainty of each status for an input value can be determined from the membership function.

The control rules are as follows:

(1) The longer the rotation time of the photoconductor, the larger the wear amount of the photoconductive layer;

(2) The smaller the deposition amount of toner onto the photoconductor ground, the smaller the wear amount of the photoconductive layer; and (3) If the deposition amount of toner onto the photoconductor ground is large and both toner concentration and humidity are standard, then the wear amount of the photoconductive layer is large.

Such rules obtained based on various experiments and designer's experiences are prepared. In this embodiment, nineteen control rules are defined as shown in Table 3 below:

TABLE 3

| Rotation time of photo-conductor | Depo-sition amount on ground | Toner concent-ration | Humi-dity | Drive time of devel-oping unit | Wear amount of photocon-ductive layer |
|---|---|---|---|---|---|
| ZO | | | | | ZO |
| PS | | | | | PS |
| PL | | | | | PL |
| | ZO | | | | ZO |
| | PS | Z | Z | ZO | PS |
| | PS | P | | | ZO |
| | PS | N | | | PS |
| | PS | | P | | ZO |
| | PS | | N | | PS |
| | PS | | | PS | ZO |
| | PL | Z | Z | ZO | PL |
| | PL | P | | | PS |
| | PL | N | | | PL |

TABLE 3-continued

| Rotation time of photo-conductor | Depo-sition amount on ground | Toner concent-ration | Humi-dity | Drive time of devel-oping unit | Wear amount of photocon-ductive layer |
|---|---|---|---|---|---|
| | PL | | P | | PS |
| | PL | | N | | PL |
| | PL | | | PS | PS |
| | PL | P | P | | ZO |
| | PL | P | | PS | ZO |
| | PL | | P | PS | ZO |

Based on the above control rules and membership functions, the wear amount of the photoconductive layer is estimated, for example, by the min-max force placement method. Then, the outputted wear amount of the photoconductive layer is compared with a predetermined limit wear amount, where if the former is larger than the latter, the photoconductor is decided to have reached the end of life.

Figure 17:
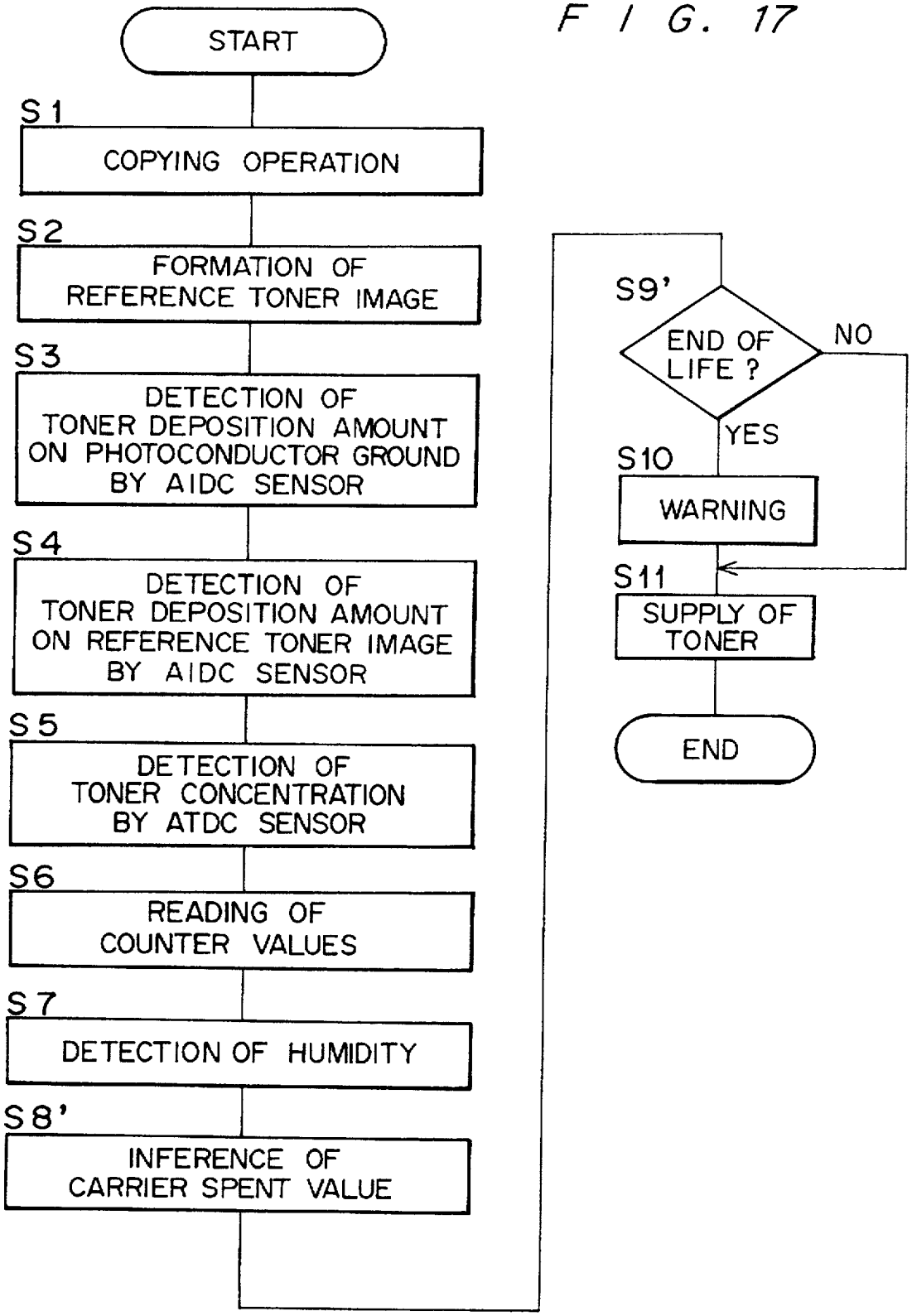
FIG. 17 is a flowchart showing the control procedure of a digital copying machine which is another embodiment.
Figure 18:
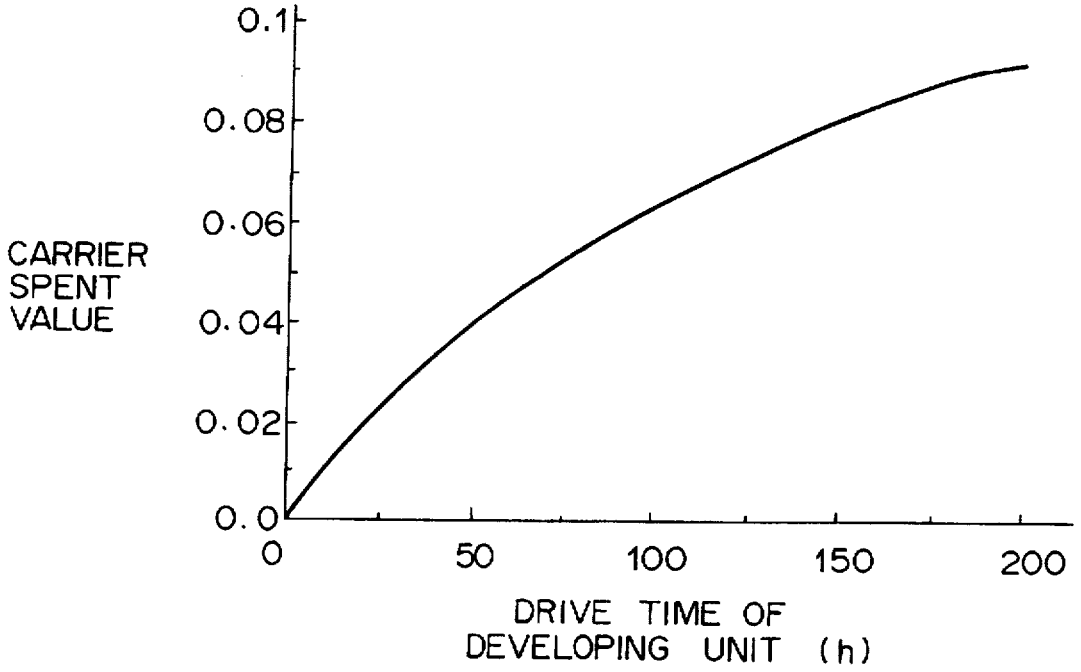
FIG. 18 is a graph showing the relationship between drive time of developing unit and carrier spent value.
Figure 19:
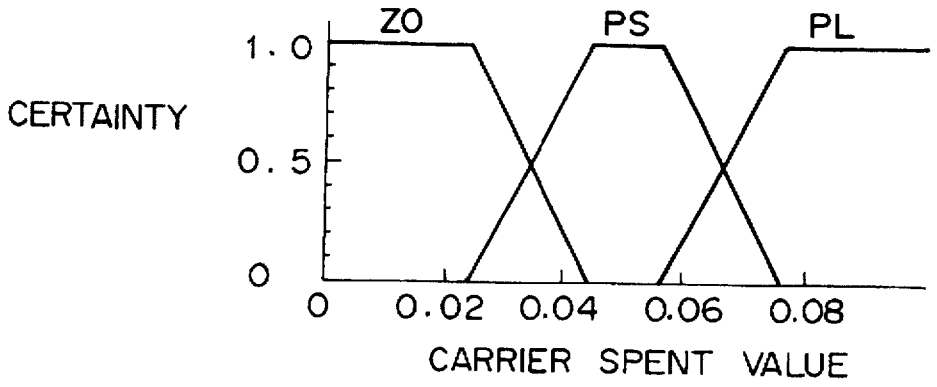
FIG. 19 is a chart showing a membership function (carrier spent value) in the fuzzy inference method.

(Second Embodiment, see FIGS. 17, 18, 19)

The second embodiment is to decide the end of life of the developer, in which the copying machine is of the same construction as that of FIGS. 1 and 2. Accordingly, the control procedure for the copying machine as shown in FIG. 17 is basically similar to the flowchart as shown in FIG. 5, where the carrier spent value is estimated at step S8' based on detection values from the sensors 51, 52, 54 as well as information from the PC counter and the development counter. At step S9', it is decided whether or not the developer has reached the end of life, where if it has, a warning is issued at step S10.

Now an explanation is made on the relationship between data obtained from the image forming process and the life of the developer.

The life of the developer can be determined in terms of a physical property value showing the degree of deterioration of the carrier, which is called carrier spent value. As the carrier spent value increases, the chargeability to toner lowers, as described before. Generally, the carrier spent value increases as the developer is subjected to physical stress while being stirred.

FIG. 18 shows the carrier spent value versus the drive time of the developing unit in this copying machine. This data was obtained by continuously driving the developing unit 23 under a normal environment of laboratories. In individual actual machines, however, because of differences in the history of use of printing modes, the carrier spent value could not be estimated by using the data of FIG. 18 as it is. Also, as the carrier spent value increases, toner fogging becomes more likely to occur to the image background part for digital copying machines that involve reversal developing process. The toner fogging can be discriminated by detecting the deposition amount of toner onto the photoconductor ground by the AIDC sensor 51. However, the fogging also occurs when the charged level of toner has lowered due to an increase in humidity, or when the toner concentration in the developer has increased excessively for some reason, or when the charged potential of toner has lowered due to wear of the photoconductive layer. Therefore, the carrier spent value cannot be estimated only by detecting the fogging of toner.

The carrier spent value can be correctly estimated by detecting the deposition amount of toner onto the photoconductor ground, the humidity, the toner concentration, and the cumulative rotation time of the photoconductive drum 21 in addition to the cumulative drive time of the developing unit 23, and by comprehensively evaluating these detected values. For instance, when such conditions as a long drive time of the developing unit 23, a large deposition amount of toner onto the photoconductor ground, a high humidity, and a high toner concentration have been obtained from output values of the various sensors and counters, it can be considered that the factors for the large deposition amount of toner onto the photoconductor ground are the high humidity and the high toner concentration in addition to the long drive time of the developing unit 23. This case, it can be inferred, is less likely to be an occurrence of fogging due to the deterioration of the carrier.

As described above, there is a correlation between the data obtained from the image forming process and the carrier spent value, so that the carrier spent value can be correctly estimated by making a decision from various types of process data. Conventionally, because of a large number of parameters for the carrier deterioration, it has been impossible to determine the input and output by giving a definition with definite relational expressions.

Thus, the present second embodiment employs a method using a neural network or a method using fuzzy inference for the estimation of the carrier spent value at the foregoing step S8'.

First explained is the method of inference using a neural network.

In this inference method, output values from various sensors and counters with the state of image forming process varied are fetched, and the actually measured carrier spent value at that time are taken as teacher values, with which the learning of the neural network is executed. After the learning, output values of the sensors and counters are fed as input values of the neural network, from which a carrier spent value is acquired and the life of the developer is estimated.

The neural network is made up in a three-layer structure similar to that of the neural network as shown in FIG. 7, where the input/output of each unit is also as shown in FIG. 8. Further, the learning model of the neural network is implemented also by the procedure shown in FIG. 9, where the three-layer back propagation method as shown in FIG. 10 is employed. The three-layer back propagation method has already been explained in the first embodiment and so omitted here.

In this embodiment, the teacher data obtained by experiments are standardized within the ranges shown in Table 4 below in order to yield an output value of the neural network:

TABLE 4

| | | Min.-Max. |
|---|---|---|
| Input data | Drive time of developing unit | 0–12000 (m) |
| | Deposition amount of toner on ground | 0–0.1 (mg/cm$^2$) |
| | Toner concentration | 0–10 (%) |
| | Humidity in machine | 0–100 (%) |
| | Rotation time of photoconductor | 0–100000 (m) |
| Output data | Carrier spent value | 0–0.1 |

For example, given teacher data is standardized as shown in Table 5 below:

TABLE 5

| | | Before standard-ization → | After standard-ization |
|---|---|---|---|
| Input data | Drive time of developing unit | 3000 → | 0.25 |
| | Deposition amount of toner on ground | 0.02 → | 0.2 |
| | Toner concentration | 6 → | 0.6 |
| | Humidity in machine | 20 → | 0.2 |
| | Rotation time of photoconductor | 60000 → | 0.6 |
| Output data | Carrier spent value | 0.02 → | 0.2 |

Teacher data obtained by experiments are standardized in this way, and the learning is executed by using the standardized teacher data. In this embodiment, the number of pieces of teacher data is 120 in all, and the learning is iterated until the square error is minimized to a sufficiency by a computer, by which the coupling weights and the thresholds are determined.

After the completion of the learning, the processing program for the part of calculating the output of the neural network having the determined coupling weights and thresholds is incorporated into the control program ROM as a routine for estimating the carrier spent value.

In copying process, data obtained from outputs of the various sensors and counters are standardized so as to match the type of input and output of the neural network, and then incorporated as input values for the processing program of the neural network, followed by calculation of an output value. The output value is converted from the standardized value into an actual value, by which a carrier spent value is obtained.

Otherwise, without incorporating the processing program of the neural network into the control ROM, the carrier spent value may be obtained by calculating an output value for the combination of inputs by a previously learned neural network, incorporating the calculated values into data ROM as a data table, and by selecting output data for input data from the data table.

Next, the fuzzy inference method is explained.

In this case, the life of the developer is determined by defining the status amounts of various processes with membership functions, preparing control rules from the relationship obtained from experiments or the like and executing a fuzzy inference method for outputting a carrier spent value with the status amounts of the processes taken as inputs. In this embodiment, the inputs are drive time of the developing unit, deposition amount of toner on the photoconductor ground, toner concentration, humidity, and rotation time of the photoconductor, while the output is carrier spent value.

As the membership functions, the fuzzy sets of process status amounts and control amounts are defined as shown in FIGS. 11 to 15, while the carrier spent value is defined as shown in FIG. 19. Reference characters shown in FIGS. 11 to 15 are as described in the first embodiment, and for the carrier spent value in FIG. 19, ZO: standard PS: a little large PL: very large The control rules are as follows:

(1) The longer the drive time of the developing unit, the larger the carrier spent value;

(2) The smaller the deposition amount of toner onto the photoconductor ground, the smaller the carrier spent value; and (3) If the deposition amount of toner onto the photoconductor ground is high and both toner concentration and humidity are standard, then the carrier spent value is large.

Such rules obtained based on various experiments and designer's experiences are prepared. In this embodiment, nineteen control rules are defined as shown in Table 6 below:

TABLE 6

| Drive time of developing unit | deposition amount on ground | Toner concentration | Humidity | Rotation time of photoconductor | Carrier spent value |
|---|---|---|---|---|---|
| ZO | | | | | ZO |
| PS | | | | | PS |
| PL | | | | | PL |
| | ZO | | | | ZO |
| | PS | Z | Z | ZO | PS |
| | PS | P | | | ZO |
| | PS | N | | | PS |
| | PS | | P | | ZO |
| | PS | | N | | PS |
| | PS | | | PS | ZO |
| | PS | | | PL | PS |
| | PL | Z | Z | ZO | PL |
| | PL | P | | | PS |
| | PL | n | | | PL |
| | PL | | P | | PS |
| | PL | | N | | PS |
| | PL | | | ZO | PS |
| | PL | | | PS | PL |
| | PL | P | P | | ZO |
| | PL | P | | ZO | ZO |
| | PL | | P | ZO | ZO |

Based on the above control rules and membership functions, the carrier spent value is estimated, for example, by the min-max force placement method. Then, the outputted carrier spent value is compared with a predetermined limit carrier spent value, where if the former is larger than the latter, the developer is decided to have reached the end of life.

In the above-described neural network, the learning by the back propagation method using a three-layer neural network is executed. Otherwise, it is also possible to employ a method of building up an optimum neural network by varying such parameters as the number of layers of the neural network, the number of units, the thresholds of the units and the response function.

In the above-described fuzzy inference method, the min-max force placement method is used to calculate the control amounts. Otherwise, also available are those methods which are different in inference procedure from the above, such as a simplification inference method in which the consequent conditional terms of the inference rules are defined not as a fuzzy set but as a constant and the control amounts are calculated by weighted average, or a function type inference method in which the consequent conditional terms are defined as a function. Furthermore, the configuration of the membership functions, the number and contents of the inference rules may be changed according to experiences and experimental results.

Although the above embodiment is described using a digital copying machine as an example, the present invention is not limited to the digital copying machine, and may be applied to various electrophotographic image forming apparatuses such as a laser printer and a facsimile.

Although the present invention has been described in connection with the preferred embodiments above, it is to be noted that various changes and modifications are apparent to a person skilled in the art. Such changes and modifications are to be understood as being within the scope of the present invention.

What is claimed is:

1. An image forming apparatus for developing a latent image formed on a photoconductor into a toner image with a developer, and then transferring the toner image onto a sheet, the image forming apparatus comprising:

detection means for detecting factors relating to degree of consumption of a consumable article; and decision means for estimating the degree of consumption of the consumable article based on detected values of the detection means and then deciding whether the consumable article has reached an end of life, wherein the decision means utilizes a fuzzy inference method.

2. An image forming apparatus as claimed in claim 1, wherein the fuzzy inference method expresses relationships between detected values of the detection means and degree of consumption of the consumable article by membership functions and control rules, said control rules having antecedent conditional terms described with detected values of the detection means and having consequent conditional terms described with estimates of a physical property value, and the fuzzy inference method gives the detected values of the detection means to the antecedent conditional terms as input values so as to yield a fuzzy output value of the consequent conditional terms, whereby the decision means decides, with the resulting output value taken as the degree of consumption, whether the consumable article has reached an end of life.

3. An image forming apparatus for developing a latent image formed on a photoconductor into a toner image with a developer, and then transferring the toner image onto a sheet, the image forming apparatus comprising:

detection means for detecting factors relating to degree of consumption of a consumable article; and decision means for estimating the degree of consumption of the consumable article based on detected values of the detection means and then deciding whether the consumable article has reached an end of life, wherein the decision means executes learning of a neural network.

4. An image forming apparatus as claimed in claim 3, wherein the learning of a neural network comprises detected values of the detection means taken as input values and a value indicating preset degree of consumption of the consumable article taken as a teacher value, and after the learning, the decision means determines the degree of consumption by using the neural network with the detected values of the detection means given as input values, whereby the decision means decides, based on the resulting degree of consumption, whether the consumable article has reached an end of life.

5. An image forming apparatus as claimed in either of claims 1 or 3, wherein the detection means detects at least one of cumulative rotation time of the photoconductor and cumulative drive time of a developing unit, and further detects at least one of deposition amount of toner onto the photoconductor, toner concentration in the developer and humidity.

6. An image forming apparatus as claimed in either of claims 1 or 3, further comprising warning means for, when the decision means has decided that the consumable article has reached an end of life, displaying a warning on an operation panel or issuing a warning to an external through a telephone line.

7. An image forming apparatus for developing a latent image formed on a photoconductor into a toner image with a developer, and then transferring the toner image onto a sheet, the image forming apparatus comprising:

detection means for detecting factors which cause a photoconductive layer of the photoconductor to be worn; and decision means for estimating the wear amount of the photoconductive layer based on detected values of the detection means and then deciding whether the photoconductor has reached an end of life, wherein the decision means utilizes a fuzzy inference method.

8. An image forming apparatus as claimed in claim 7, wherein the fuzzy inference method expresses relationships between detected values of the detection means and the wear amount of the photoconductive layer by membership functions and control rules, said control rules having antecedent conditional terms described with detected values of the detection means and having consequent conditional terms described with estimates of a physical property value, and the fuzzy inference method gives the detected values of the detection means to the antecedent conditional terms as input values so as to yield a fuzzy output value of the consequent conditional terms, whereby the decision means decides, with the resulting output value taken as the wear amount whether the photoconductor has reached an end of life.

9. An image forming apparatus for developing a latent image formed on a photoconductor into a toner image with a developer, and then transferring the toner image onto a sheet, the image forming apparatus comprising:

detection means for detecting factors which cause a photoconductive layer of the photoconductor to be worn; and decision means for estimating the wear amount of the photoconductive layer based on detected values of the detection means and then deciding whether the photoconductor has reached an end of life, wherein the decision means executes learning of a neural network.

10. An image forming apparatus as claimed in claim 9, wherein the learning of a neural network comprises detected values of the detection means taken as input values and a preset wear amount of the photoconductive layer taken as a teacher value, and after the learning, the decision means determines the wear amount by using the neural network with the detected values of the detection means given as input values, whereby the decision means decides, based on the resulting wear amount, whether the photoconductor has reached an end of life.

11. An image forming apparatus as claimed in either of claims 7 or 9, wherein the detection means detects at least one of cumulative rotation time of the photoconductor and cumulative drive time of a developing unit, and further detects at least one of deposition amount of toner onto the photoconductor, toner concentration in the developer and humidity.

12. An image forming apparatus as claimed in either of claims 7 or 9, further comprising warning means for, when the decision means has decided that the photoconductor has reached an end of life, displaying a warning on an operation panel or issuing a warning to an external through a telephone line.

13. An image forming apparatus for developing a latent image formed on a photoconductor into a toner image with a developer, and then transferring the toner image onto a sheet, the image forming apparatus comprising:

detection means for detecting factors which cause carrier contained in the developer to deteriorate; and decision means for estimating a carrier spent value based on detected values of the detection means and then deciding whether the developer has reached an end of life, wherein the decision means utilizes a fuzzy inference method.

14. An image forming apparatus as claimed in claim 13, wherein the fuzzy inference method expresses relationships between detected values of the detection means and the carrier spent value by membership functions and control rules, said control rules having antecedent conditional terms described with detected values of the detection means and having consequent conditional terms described with estimates of a physical property value, and the fuzzy inference method gives the detected values of the detection means to the antecedent conditional terms as input values so as to yield a fuzzy output value of the consequent conditional terms, whereby the decision means decides, with the resulting output value taken as the carrier spent value, whether the developer has reached an end of life.

15. An image forming apparatus for developing a latent image formed on a photoconductor into a toner image with a developer, and then transferring the toner image onto a sheet, the image forming apparatus comprising:

detection means for detecting factors which cause carrier contained in the developer to deteriorate; and decision means for estimating a carrier spent value based on detected values of the detection means and then deciding whether the developer has reached an end of life, wherein the decision means executes learning of a neural network.

16. An image forming apparatus as claimed in claim 15, wherein the learning of a neural network comprises detected values of the detection means taken as input values and a preset carrier spent value taken as a teacher value, and after the learning, the decision means determines the carrier spent value by using the neural network with the detected values of the detection means given as input values, whereby the decision means decides, based on the resulting carrier spent value, whether the developer has reached an end of life.

17. An image forming apparatus as claimed in either of claims 13 or 15, wherein the detection means detects at least one of cumulative rotation time of the photoconductor and cumulative drive time of a developing unit, and further detects at least one of deposition amount of toner onto the photoconductor, toner concentration in the developer and humidity.

18. An image forming apparatus as claimed in either of claims 13 or 15, further comprising warning means for, when the decision means has decided that the developer has reached an end of life, displaying a warning on an operation panel or issuing a warning to an external through a telephone line.

19. A method of deciding whether a consumable article has reached an end of life in an image forming apparatus for developing a latent image formed on a photoconductor into a toner image with a developer and then transferring the toner image onto a sheet, the method comprising:

a first step of detecting factors relating to degree of consumption of a consumable article; and a second step of estimating the degree of consumption of the consumable article based on detected values obtained in the first step and then deciding whether the consumable article has reached an end of life, wherein the second step utilizes a fuzzy inference method.

20. A method as claimed in claim 19, wherein the fuzzy inference method expresses relationships between values of the factors and degree of consumption of the consumable article by membership functions and control rules, said control rules having antecedent conditional terms described with values of the factors and having consequent conditional terms described with estimates of a physical property value, and the fuzzy inference method gives the detected values obtained in the first step to the antecedent conditional terms as input values so as to yield a fuzzy output value of the consequent conditional terms, whereby with the resulting output value taken as the degree of consumption, whether the consumable article has reached an end of life is decided.

21. A method of deciding whether a consumable article has reached an end of life in an image forming apparatus for developing a latent image formed on a photoconductor into a toner image with a developer and then transferring the toner image onto a sheet, the method comprising:

a first step of detecting factors relating to degree of consumption of a consumable article; and a second step of estimating the degree of consumption of the consumable article based on detected values obtained in the first step and then deciding whether the consumable article has reached an end of life, wherein the second step involves learning of a neural network.

22. A method as claimed in claim 21, wherein the learning of a neural network is executed with values of the factors taken as input values and values indicating preset degree of consumption of the consumable article taken as teacher values, and after the learning, the degree of consumption is determined by using the neural network with the detected values obtained in the first step given as input values, whereby based on the resulting degree of consumption, whether the consumable article has reached an end of life is decided.

23. A method as claimed in either of claims 19 or 21, wherein:

the first step is a step of detecting factors which cause a photoconductive layer of the photoconductor to be worn; and the second step is a step of estimating the wear amount of the photoconductive layer based on detected values obtained in the first step and then deciding whether the photoconductor has reached an end of life.

24. A method as claimed in either of claims 19 or 21, wherein:

the first step is a step of detecting factors which cause carrier contained in the developer to deteriorate; and the second step is a step of estimating a carrier spent value based on detected values obtained in the first step and then deciding whether the developer has reached an end of life.

25. An electrophotographic image forming apparatus comprising:

a detector which detects factors relating to degree of consumption of a consumable article used in the image forming apparatus; and a processing unit which estimates the degree of consumption of the consumable article based on detected values of the detector and then obtains the life of the consumable article, wherein the processing unit utilizes a fuzzy inference method.

26. An electrophotographic image forming apparatus comprising:

a detector which detects factors relating to degree of consumption of a consumable article used in the image forming apparatus; and a processing unit which estimates the degree of consumption of the consumable article based on detected values of the detector and then obtains the life of the consumable article, wherein the processing unit executes learning of a neural network.

* * * * *